US007146117B2

(12) United States Patent
Song et al.

(10) Patent No.: US 7,146,117 B2
(45) Date of Patent: Dec. 5, 2006

(54) METHOD OF CONTROLLING TEMPERATURE OF FUSER OF IMAGE FORMING APPARATUS

(75) Inventors: Hyun-soo Song, Suwon-si (KR); Jung-kuk Kim, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 205 days.

(21) Appl. No.: 10/920,288

(22) Filed: Aug. 18, 2004

(65) Prior Publication Data

US 2005/0141913 A1 Jun. 30, 2005

(30) Foreign Application Priority Data

Dec. 29, 2003 (KR) ..... 10-2003-0098605

(51) Int. Cl.
*G03G 15/20* (2006.01)

(52) U.S. Cl. ..... 399/69

(58) Field of Classification Search ..... 399/67, 399/69; 219/216

See application file for complete search history.

(56) References Cited

U.S. PATENT DOCUMENTS 6,240,263 B1 * 5/2001 Watanabe et al. ..... 399/69

FOREIGN PATENT DOCUMENTS

| | | |
|---|---|---|
| JP | 6-67563 | 3/1994 |
| JP | 11-95604 | 4/1999 |
| JP | 2000-150110 | 5/2000 |
| JP | 2002-351253 | 12/2002 |

OTHER PUBLICATIONS

Korean Office Action issued with respect to Korean Application No. 2003-98605 (Issue date: Nov. 18, 2005).

* cited by examiner

*Primary Examiner*—Susan Lee
(74) *Attorney, Agent, or Firm*—Staas & Halsey LLP

(57) ABSTRACT

A method of controlling temperature of a fuser of an image forming apparatus includes measuring the temperature of the fuser, comparing the measured temperature with a previously measured temperature and determining whether the temperature of the fuser is ascending or descending to differentiate a temperature ascending stage and a temperature descending stage from each other, and controlling a chopping rate of the switching unit that intermittently connects power to the fuser. Reducing unnecessary power consumption is possible because the temperature of the fuser is controlled by differentiating a temperature ascending stage and a temperature descending stage from each other, and the quality of image may be enhanced and a flicker phenomenon is prevented.

21 Claims, 3 Drawing Sheets

METHOD OF CONTROLLING TEMPERATURE OF FUSER OF IMAGE FORMING APPARATUS

CROSS-REFERENCE TO RELATED APPLICATIONS

This application claims the benefit of Korean Patent Application No. 2003-98605 filed on Dec. 29, 2003, in the Korean Intellectual Property Office, the disclosure of which is incorporated herein by reference in its entirety.

BACKGROUND OF THE INVENTION

1. Field of the Invention

The present invention relates to an image forming apparatus and, in particular, to a method of controlling temperature of a fuser of an image forming apparatus, in which the temperature of the fuser is measured, a temperature ascending stage and a temperature descending stage are differentiated from one another, and optimized temperature control is performed for each stage.

2. Description of the Related Art

An ordinary image forming apparatus, such as an electrophotographic image forming apparatus prints out a desired image by developing an electrostatic latent image formed on a photosensitive medium using toner to form a toner image, transferring the toner image on the photosensitive medium onto a sheet, and fixing the toner image on the sheet by applying heat and pressure in the fuser.

FIG. 1 is a perspective view schematically showing a conventional fuser. The fuser 10 comprises a fixing roller 11, and a compression roller 12 installed to be in contact with and to be compressed against the fixing roller with a predetermined pressure. A heating lamp 13 is installed within the fixing roller 11 to heat the fixing roller 11. The fixing roller 11 is also provided with a temperature detection sensor 14, so that the temperature of the fixing roller 11 can be detected.

The temperature of the fixing roller 11 of the fuser 10 is set to be varied depending on the operating condition of the fuser 10. Typically, the temperature is set to about 150° C. in the ready mode and set to about 180° C. in the printing mode. The temperature of the fixing roller 11 is controlled by a temperature control unit (not shown in the drawing) that intermittently connects a power supply with the heating lamp 13 in response to an output of the temperature detection sensor 14 that detects the temperature of the fixing roller 11.

A conventional method to control the temperature of a fuser is performed by turning a given switching unit off and on with a predetermined control period. The method divides the temperature range of the fuser, measured through the temperature detection sensor, into several intervals and controls a chopping rate of the switching unit of each interval, as shown in FIG. 2. Chopping rates of the switching unit are shown in Table 1.

TABLE 1

| Interval | Chopping rate (%) |
|---|---|
| T1~T2 | 50 |
| T2~T3 | 30 |
| above T3 | 0 |
| T3~T2 | 30 |
| T2~T1 | 50 |
| below T1 | 100 |

Each chopping rate indicated in Table 1 is defined in such a manner that if an ON signal of power is applied to the heating lamp 13 of the fuser ten times for 100 ms, the chopping rate is defined as 100%. Therefore, 50% means that the ON signal is applied to the heating lamp 13 five times for 100 ms, 30% means that the ON signal is applied to the heating lamp 13 three times for 100 ms, and 0% means that only an OFF signal is applied to the heating lamp 13.

However, if power is applied to the heating lamp by the operation controlled as described above, when an inrush of current having a magnitude of tens of amperes, which is produced due to a sharp drop of AC voltage, is applied, occurrence of overshoot may not be avoided. In addition, the flicker phenomenon that causes the heating lamp 13 to flicker is produced since the power applied to the heating lamp 13 is caused to fluctuate. If the flicker phenomenon is produced, the life span of the heating lamp is shortened. Additionally, precisely controlling the temperature is, image quality of image may be adversely affected.

SUMMARY OF THE INVENTION

Accordingly, the present invention has been conceived to solve the above-mentioned problems occurring in the prior art, and an object of the present invention is to provide a method of controlling a temperature of a fuser of an image forming apparatus in which a control operation for each temperature interval is improved so as to prevent a flicker phenomenon from being produced in the fuser.

Thus, a method of controlling temperature of a fuser of an image forming apparatus in which a toner image is fixed by applying heat and pressure to a surface of a sheet on which the toner image has been formed while the sheet passes an image forming interval, comprises: measuring the temperature of the fuser; comparing the measured temperature with the measured temperature and determining whether the temperature of the fuser is ascending or descending; controlling temperature ascent in such a manner that in a temperature ascending stage, during which the temperature of the fuser is ascending, the temperature of the fuser is controlled by varying a chopping rate of a switching unit that intermittently connects power to the fuser; and controlling temperature descent in such a manner that in a temperature descending stage, during which the temperature of the fuser is descending, the temperature of the fuser is controlled by varying the chopping rate of the switching unit that intermittently connects power to the fuser.

According to an aspect of the present invention, in the step of controlling temperature ascent, the control may be performed while varying the chopping rate of the switching unit in the order of 100%, 50%, 30% and 0% depending on the change of the temperature of the fuser.

At that time, in an aspect of the invention, the power applied to the fuser is cut off by turning the chopping rate to 0% when the fuser is heated over a critical temperature that renders the fuser to be overheated.

In addition, while controlling the temperature descent, the control may be performed while varying the chopping rate of the switching unit in the order of 0%, 10% and 100% depending on the changed of the temperature of the fuser.

At that time, in another aspect of the invention, the controlling temperature descent comprises: preheating the fuser by setting the chopping rate of the switching unit to 10% so as to start preheating of the fuser, when the fuser is cooled to a temperature below a preheating starting temperature; and heating the fuser by setting the chopping rate of the switching unit to 100% so as to heat the fuser, when the fuser is cooled to a temperature below a heating starting temperature.

Additional and/or other aspects and advantages of the invention will be set forth in part in the description which follows and, in part, will be obvious from the description, or may be learned by practice of the invention.

BRIEF DESCRIPTION OF THE DRAWINGS

The above and/or other aspects, and advantages of the present invention will be more apparent from the following detailed description taken with reference to the accompanying drawings, in which.

DETAILED DESCRIPTION OF THE PREFERRED EMBODIMENTS

Figure 1:
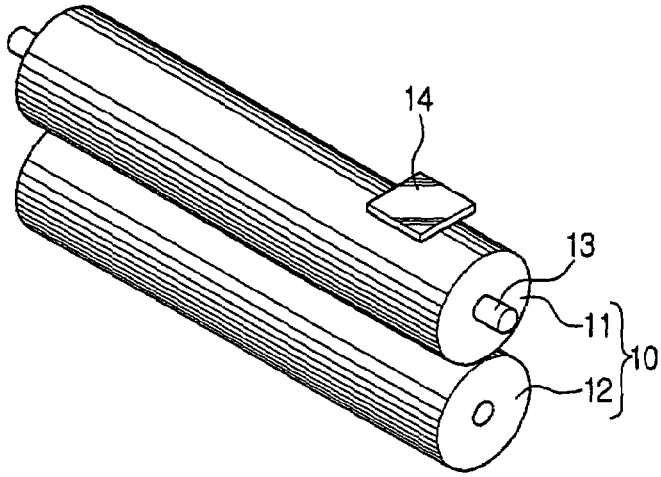
FIG. 1 is a perspective view schematically showing a construction of a conventional fuser.
Figure 2:
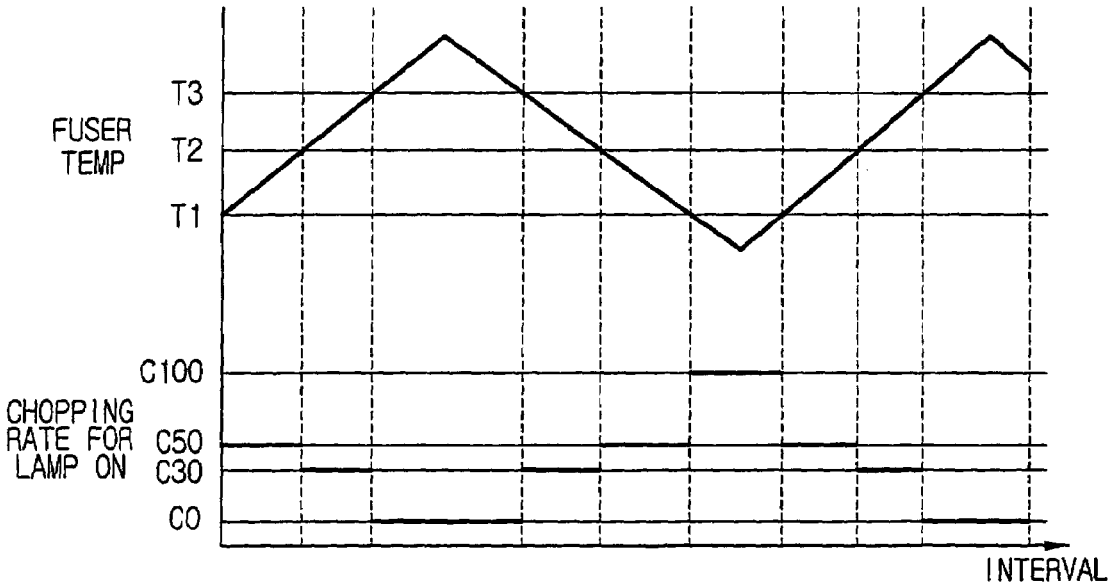
FIG. 2 is a graph showing a chopping rate of each temperature interval of a fuser according to the prior art.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 3:
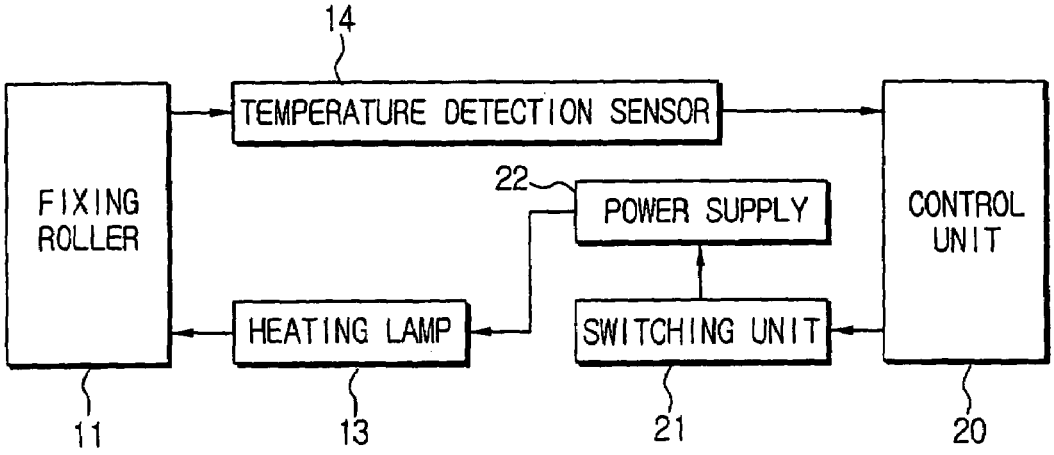
FIG. 3 is a block diagram of controlling temperature of a fuser according to an embodiment of the present invention.
Figure 4:
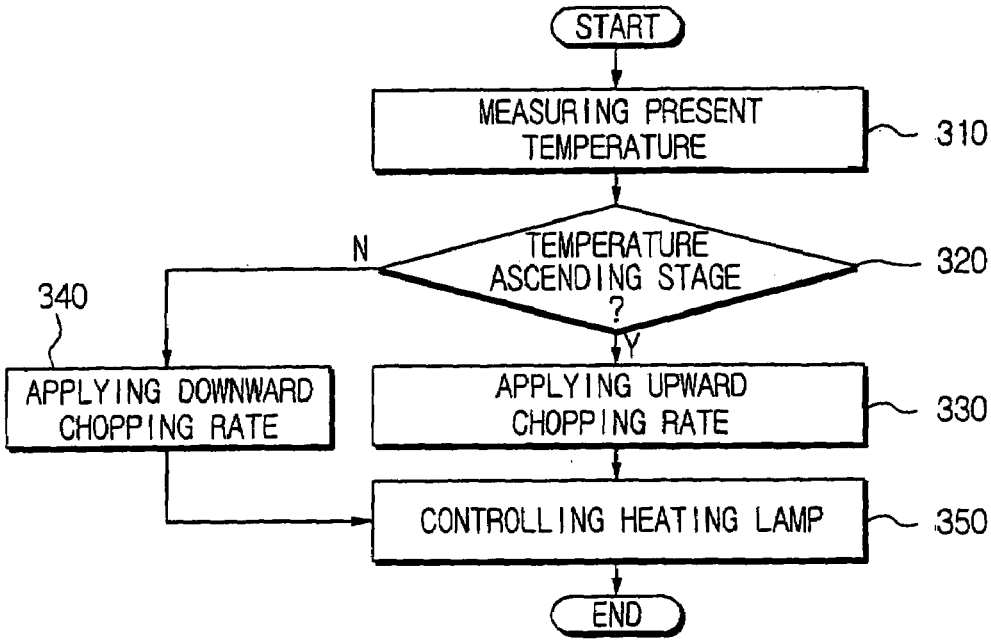
FIG. 4 is a flowchart showing a method of controlling temperature of a fuser according to an embodiment of the present invention.

FIGS. 3 and 4 are a block diagram and flowchart each to illustrate a temperature control of a fuser according to an embodiment of the present invention.

A temperature detection sensor 14, installed in a fixing roller 11, detects the change of temperature of the fuser and transmits data to a control unit 20 (310).

The control unit 20 compares previous data and present data through the data transmitted from the temperature detection sensor 14 and determines whether the temperature of the fixing roller 11 is ascending or descending (320).

The control unit 20 determines whether the temperature of the fixing roller 11 is ascending or descending, and applies respective control signals to a switching unit 21 with a temperature ascending stage and a temperature descending stage being differentiated from one another. The control signals render the switching unit 21 to alternately output ON/OFF signals to a power supply 22 over respective intervals A, B, C, D and E that have been set in relation to optimum level of temperature. In embodiments of the invention, reference temperatures to drive the respective intervals according to the optimum embodiment of the present invention are as indicated in Table 2 below.

TABLE 2

| | Temperature |
|---|---|
| T1 | 180 |
| T2 | 185 |
| T3 | 190 |
| T4 | 191 |
| T5 | 183 |

Therefore, the switching unit 21 intermittently supplies ON/OFF signal with reference to the temperatures indicated in Table 2, and chopping rates of the switching unit are as indicated in Table 3 below.

TABLE 3

| Interval | Temperature Range | Chopping Rate (%) |
|---|---|---|
| A | T1~T1 | 50 |
| B | T2~T3 | 30 |
| C | T3~T4 | 0 |
| D | T4~T5 | 10 |
| E | T5~T1 | 100 |

Each chopping rate of the switching unit is indicated by percent (%) unit; when the switching unit 21 applies the ON/OFF signal ten times for 100 ms to the power supply 22, the chopping rate is determined as 100%. Remaining chopping rates are proportionally determined. Accordingly, 50% means that the ON/OFF signal is applied five times for 100 ms, 30% means that the ON/OFF signal is applied three times for 100 ms, 10% means that the ON/OFF signal is applied one time for 100 ms, 0% means that OFF state is continuously maintained. If the switching unit alternately applies ON/OFF signal in this manner, a flicker phenomenon of the heating lamp, produced by an inrush of current caused by sharp drop of voltage, may be prevented since the sharp drop of voltage applied to the heating lamp from the power supply 22 reduces to prevent the inrush of current from being applied to the heating lamp.

Accordingly, in the temperature ascending stage (intervals A to C) of the fixing roller 11 (see FIG. 1), the chopping rate of the switching unit 21 is applied to the power supply 22 in the order of 100%, 50%, 30%, and during 0% for the temperature ascending stage, respectively (330).

Figure 5:
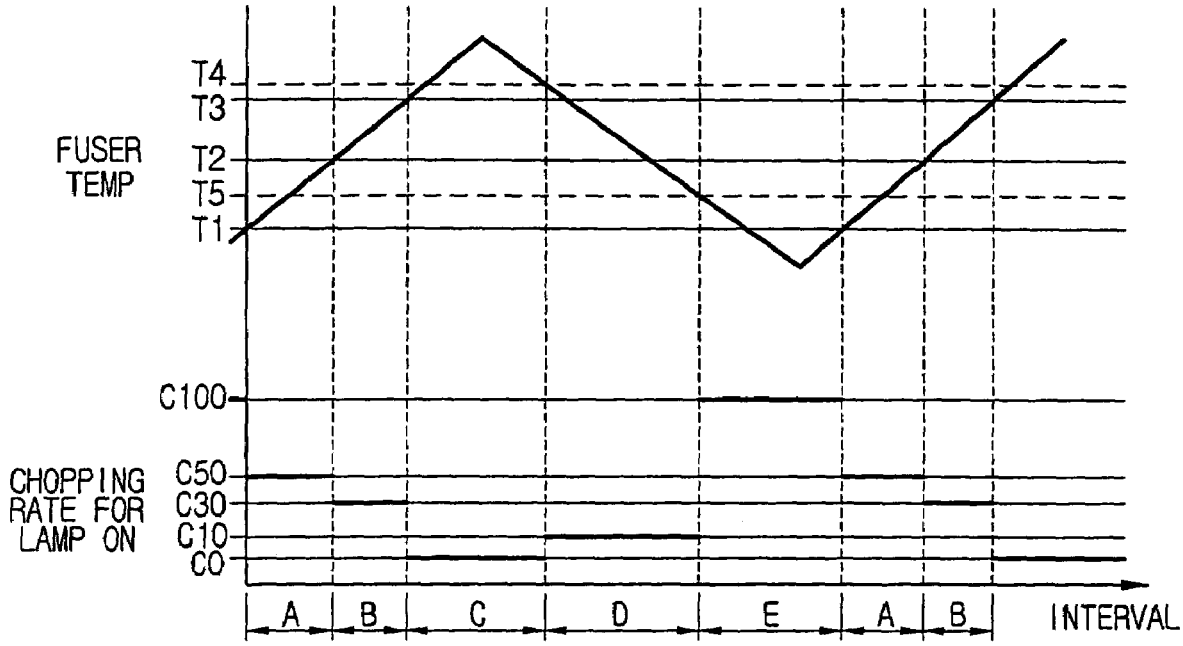
FIG. 5 is a graph showing a chopping rate of each temperature interval of a fuser according to an embodiment of the present invention.

As shown in FIG. 5, if the temperature measured in the fixing roller 11 in the printing mode ascends over an optimum fixing temperature T1 (180° C.), the switching unit 21 downwardly adjusts the chopping rate from 100% to 50% and applies a corresponding signal to the power supply 22 to decrease the temperature ascending rate of the fixing roller 11 (interval A).

If the measured temperature ascends beyond a surrounding temperature T2 (185° C.) as time goes by, the switching unit 21 downwardly adjusts the chopping rate from 50% to 10% and applies a corresponding signal to the power supply 22 to decrease the temperature ascending rate of the fixing roller 11 (interval B).

If the temperature of the fixing roller 11 ascends beyond a critical temperature T3 (190° C.) that may cause overheating, the switching unit 21 downwardly adjusts the chopping rate from 10% to 0% to prevent the fixing roller 11 from being heated any more (interval C).

Meanwhile, in the temperature descending stage (intervals C to E), the chopping rate of the switching unit 21 is applied to the power supply 22 in the order of 0%, 10%, and 100% (340).

Specifically, as shown in FIG. 5, even if the switching unit 21 turns the chopping rate into 0% to cut off power, the temperature of the fixing roller 11 may gradually ascend over a predetermined interval but the temperature will descend soon. Under this circumstance, if power is abruptly applied to the fixing roller 11, the applied power may fluctuate to produce the flicker phenomenon that causes the heating lamp to flicker. Accordingly, since preheating is required over a predetermined interval, the switching unit 21 turns the chopping rate into 10% to decrease the temperature descending rate of the fixing roller 11 when the temperature of the fixing roller 11 descends below a preheating starting temperature T4 (191° C.) as a preliminary heating step (interval D).

If the temperature of the fixing roller 11 descends continuously below a heating starting temperature T5 (183° C.), the switching unit 21 turns the chopping rate to 100% to raise the temperature of the fixing roller 11 (interval E).

Therefore, in operations 330 and 340, the heating lamp 13 is asymmetrically controlled by the chopping rate of the switching unit which is individually determined over the temperature ascending stage (intervals A to C) and the temperature descending stage (intervals C to E). In particular, in order to set a control period in the temperature descending stage, controlling temperature more precisely is possible by adding the preheating starting temperature and heating starting temperature T4, T5. In particular, during the intervals D and E, the fixing roller 11 is cooled to allow the heating efficiency of the fixing roller to be enhanced as compared to the conventional method that applies 30% and 50% chopping rates. In addition, since the ON/OFF signal application number to render the power supply 22 to be applied reduces, the power consumption may be reduced.

As is described above, according to a method of controlling temperature of a fuser of an image forming apparatus, reducing unnecessary power consumption is possible because the temperature of the fuser is controlled by differentiating a temperature ascending stage and a temperature descending stage from each other, and the quality of image can be enhanced because it is possible to prevent flicker phenomenon from being produced.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A method of controlling temperature of a fuser of an image forming apparatus which fixes a toner image by applying heat and pressure to a surface of a sheet on which the toner image has been formed while the sheet passes an image forming interval, the method comprising:

measuring the temperature of the fuser;

comparing the measured temperature with a previously measured temperature whether the temperature of the fuser is ascending or descending;

controlling a temperature ascent in such a manner that, while the temperature of the fuser is ascending, the temperature of the fuser is controlled by varying a chopping rate of a switching unit that intermittently connects power to the fuser; and controlling temperature descent in such a manner that, while the temperature of the fuser is descending, the temperature of the fuser is controlled by varying the chopping rate of the switching unit that intermittently connects power to the fuser, wherein the controlling the temperature ascent and the temperature descent are asymmetrically controlled from each other.

2. The method according to claim 1, wherein the controlling the temperature ascent comprises varying the chopping rate of the switching unit on the order of 100%, 50%, 30% and 0% depending on the change of the temperature of the fuser.

3. The method according to claim 1, wherein the controlling the temperature ascent comprises cutting the power applied to the fuser by turning the chopping rate to 0% when the fuser is heated over a critical temperature that renders the fuser to be overheated.

4. The method according to claim 2, wherein the controlling the temperature ascent comprises cutting the power applied to the fuser by turning the chopping rate to 0% when the fuser is heated over a critical temperature that renders the fuser to be overheated.

5. The method according to claim 1, wherein the controlling temperature descent comprises varying the chopping rate of the switching unit on the order of 0%, 10% and 100% depending on the change of the temperature of the fuser.

6. The method according to claim 1, wherein the controlling the temperature descent comprises:

preheating the fuser by setting the chopping rate of the switching unit set to 10%, when the fuser is cooled to a temperature below a preheating starting temperature; and heating the fuser by setting the chopping rate of the switching unit to 100%, when the fuser is cooled to a temperature below a heating starting temperature.

7. The method according to claim 5, wherein the controlling the temperature descent comprises:

preheating the fuser by setting the chopping rate of the switching unit to 10%, when the fuser is cooled to a temperature below a preheating starting temperature; and heating the fuser by setting the chopping rate of the switching unit to 100%, when the fuser is cooled to a temperature below a heating starting temperature.

8. A method of controlling temperature of a fuser of an image forming apparatus which fixes a toner image by applying heat and pressure to a surface of a sheet on which the toner image has been formed while the sheet passes an image forming interval, the method comprising:

measuring the temperature of the fuser;

comparing the measured temperature with a previously measured temperature to determine whether the temperature of the fuser is ascending or descending;

if the temperature of the fuser is ascending, controlling the temperature ascent by varying chopping rate of a switching unit that intermittently connects power to the fuser; and if the temperature of the fuser is descending, controlling the temperature descent by varying the chopping rate of the switching unit that intermittently connects power to the fuser, wherein the controlling the temperature ascent and the temperature descent, are asymmetric.

9. The method according to claim 8, wherein the controlling the temperature ascent comprises varying the chopping rate of the switching unit by approximately 100%, 50%, 30% and 0%.

10. The method according to claim 8, wherein the controlling the temperature ascent comprises cutting the power applied to the fuser.

11. The method according to claim 10, wherein the cutting comprises turning the chopping rate to approximately 0% when the fuser is heated over a critical temperature.

12. The method according to claim 9, wherein the controlling the temperature ascent comprises cutting the power applied to the fuser.

13. The method according to claim 12, wherein the cutting comprises turning the chopping rate to approximately 0% when the fuser is heated over a critical temperature.

14. The method according to claim 8, wherein the controlling the temperature descent comprises varying the chopping rate of the switching unit by approximately 0%, 10% and 100%.

15. The method according to claim 8, wherein the controlling the temperature descent comprises:

preheating the fuser when the fuser is cooled to a temperature below a preheating starting temperature; and heating the fuser when the fuser is cooled to a temperature below a heating starting temperature.

16. The method according to claim 15, wherein the preheating comprises setting the chopping rate of the switching unit set to approximately 10%.

17. The method according to claim 15, wherein the heating comprises setting the chopping rate of the switching unit to approximately 100%.

18. The method according to claim 14, wherein the controlling the temperature descent comprises:

preheating the fuser when the fuser is cooled to a temperature below a preheating starting temperature; and heating the fuser when the fuser is cooled to a temperature below a heating starting temperature.

19. The method according to claim 18, wherein the preheating comprises setting the chopping rate of the switching unit set to approximately 10%.

20. The method according to claim 18, wherein the heating comprises setting the chopping rate of the switching unit to approximately 100%.

21. A method of controlling temperature of a fuser of an image forming apparatus which fixes a toner image by applying heat and pressure to a surface of a sheet on which the toner image has been formed while the sheet passes an image forming interval, the method comprising:

determining whether the temperature of the fuser is ascending or descending;

if the temperature of the fuser is ascending, controlling the temperature ascent by varying chopping rate of a switching unit that intermittently connects power to the fuser; and if the temperature of the fuser is descending, controlling the temperature descent by varying the chopping rate of the switching unit that intermittently connects power to the fuser, wherein the controlling the temperature ascent and the temperature descent, are asymmetric.

* * * * *